United States Patent [19]

Sink

[11] 4,241,524

[45] Dec. 30, 1980

[54] ATHLETIC SHOE WITH FLEXIBLE SOLE

[76] Inventor: Jeffrey A. Sink, 123 Belmont Ave., Redwood City, Calif. 94061

[21] Appl. No.: 36,872

[22] Filed: May 7, 1979

[51] Int. Cl.[3] ..... A43B 1/10; A43B 13/04; A43B 23/28; A43B 5/00

[52] U.S. Cl. ..... 36/102; 36/32 R; 36/59 C; 36/114

[58] Field of Search ..... 36/102, 114, 59 R, 59 C, 36/32 R

[56] References Cited

U.S. PATENT DOCUMENTS

| | | | |
|---|---|---|---|
| D. 182,781 | 5/1958 | Zerkowitz | D2/320 |
| 485,459 | 11/1892 | Crocker | 36/59 C |
| 2,833,057 | 5/1958 | Hack | 36/28 X |
| 3,413,737 | 12/1968 | Kneebusch . | |
| 3,583,082 | 6/1971 | Jordan, Jr. . | |
| 3,818,617 | 6/1974 | Dassler et al. . | |
| 3,932,950 | 1/1976 | Taber | 36/59 R |
| 4,043,058 | 8/1977 | Hollister et al. | 36/102 |
| 4,045,888 | 9/1977 | Oxenberg . | |
| 4,098,011 | 7/1978 | Bowerman et al. . | |
| 4,130,947 | 12/1978 | Denn | 36/59 C |

FOREIGN PATENT DOCUMENTS

| | | | |
|---|---|---|---|
| 242559 | 9/1965 | Austria | 36/59 C |
| 1434840 | 2/1966 | France | 36/59 C |
| 2365974 | 4/1978 | France | 36/59 R |

*Primary Examiner*—James Kee Chi

*Attorney, Agent, or Firm*—Gerald L. Moore

[57] ABSTRACT

An athletic shoe for running and having a bar tread configuration providing improved traction with the running surface while cushioning the foot and providing improved flexibility so as not to limit the bending of the foot.

5 Claims, 6 Drawing Figures

ATHLETIC SHOE WITH FLEXIBLE SOLE

BACKGROUND OF THE INVENTION

During running or jogging it is important that the shoe provide adequate traction with the running surface. Traction is usually provided by cleats and the like on the bottom of the sole. In addition by making the cleats resilient the necessary cushioning effect is provided for running on hard surfaces. However in making the cleats resilient, wear frequently becomes a factor when running on such hard surfaces. While cleats provide the necessary traction and cushioning, such construction also limits the amount of surface in contact with the running surface which leads to greater wear.

Usually wear can be reduced by either increasing the amount of sole material touching the running surface or by making the sole of a more wear-resistant material. Most wear-resistant materials which can be economically adapted for use on athletic shoes are less resilient, thereby reducing the cushioning effect. This leaves the increasing of the material in contact with the running surface to counteract wear.

During running there are three stages of foot contact with the running surface. These stages are heel contact, mid-stance and toe contact or pushoff. Especially between mid-stance and pushoff, the foot must bend so that finally just the toe is in contact with the running surface. An increase in the amount of material touching the running surface usually dictates that the sole and shoe are less flexible. Naturally any loss in flexibility hinders the bending of the foot and therefore the running efficiency of the wearer. There is provided in the subject invention an athletic shoe which provides for greater surface contact between the sole and the running surface while increasing the traction with the running surface. Such achievements are further made while improving the flexibility of the sole so that proper bending of the foot can occur during running and walking.

SUMMARY OF THE INVENTION

An athletic shoe having an upper portion formed to contain the foot of the wearer with a sole fixed to the upper portion for contacting the ground. The sole includes a tread formed of bars with valleys therebetween extending along the direction of the bend lines of the foot so as to provide traction while improving the bending qualities of the shoe.

DESCRIPTION OF THE INVENTION

Figure 1:
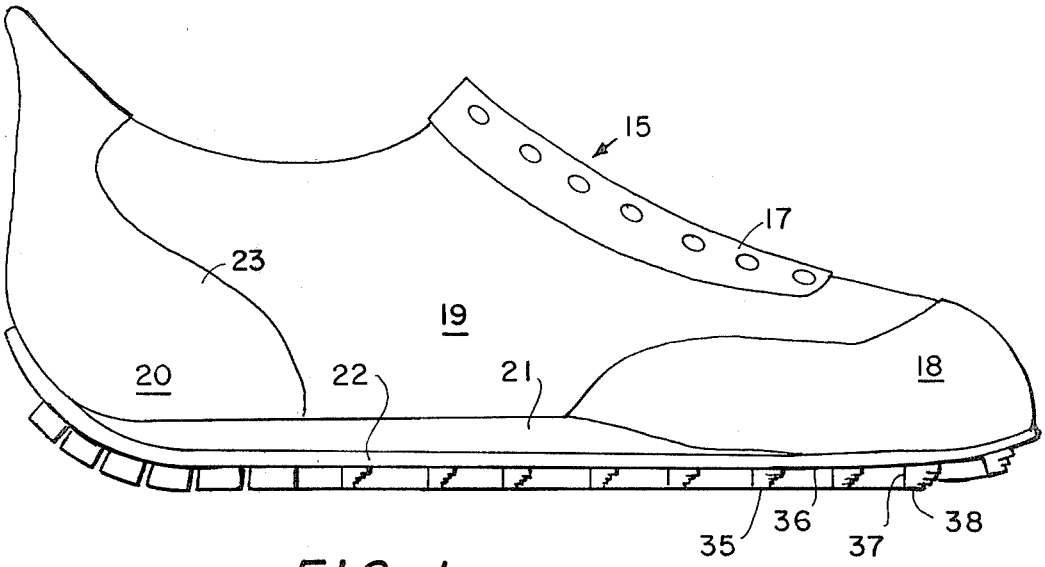
FIG. 1 is a side view of an athletic shoe embodying the present invention.

As shown primarily in FIG. 1, the invention is embodied in an athletic shoe 15 comprising an upper portion 16 formed to enclose the foot of the wearer. The shoe is of a normal configuration with the upper portion being formed of leather or nylon and being adapted for lacing by shoestrings (not shown) passed through eyelets 17. The upper portion includes a toe portion 18, a center or shank portion 19 and a heel portion 20. A pliable cushioning pad 21 having an upper surface fixed to the bottom of the upper portion provides a wearing or bottom surface 22 for contact with the ground. The upper shoe portion also includes a heel counter 23 formed to enclose and support the heel. The sole usually is fixed to the upper portion by gluing or sewing to complete the shoe.

Figure 2:
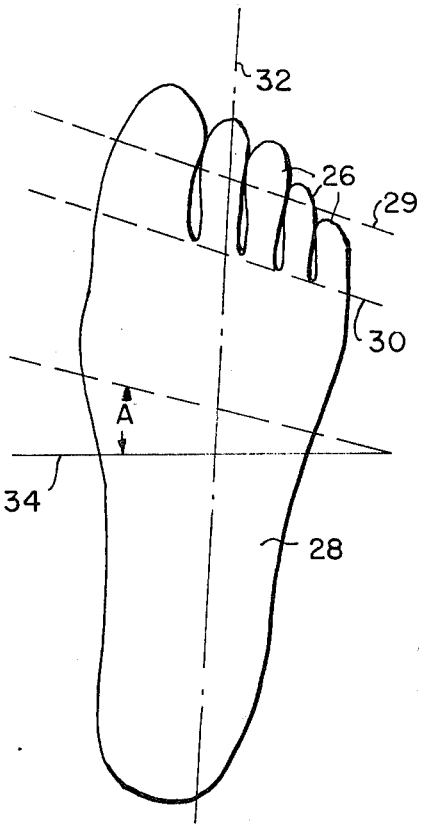
FIG. 2 is a top view of a human foot showing the approximate bend lines thereof in dotted outline.
Figure 5:
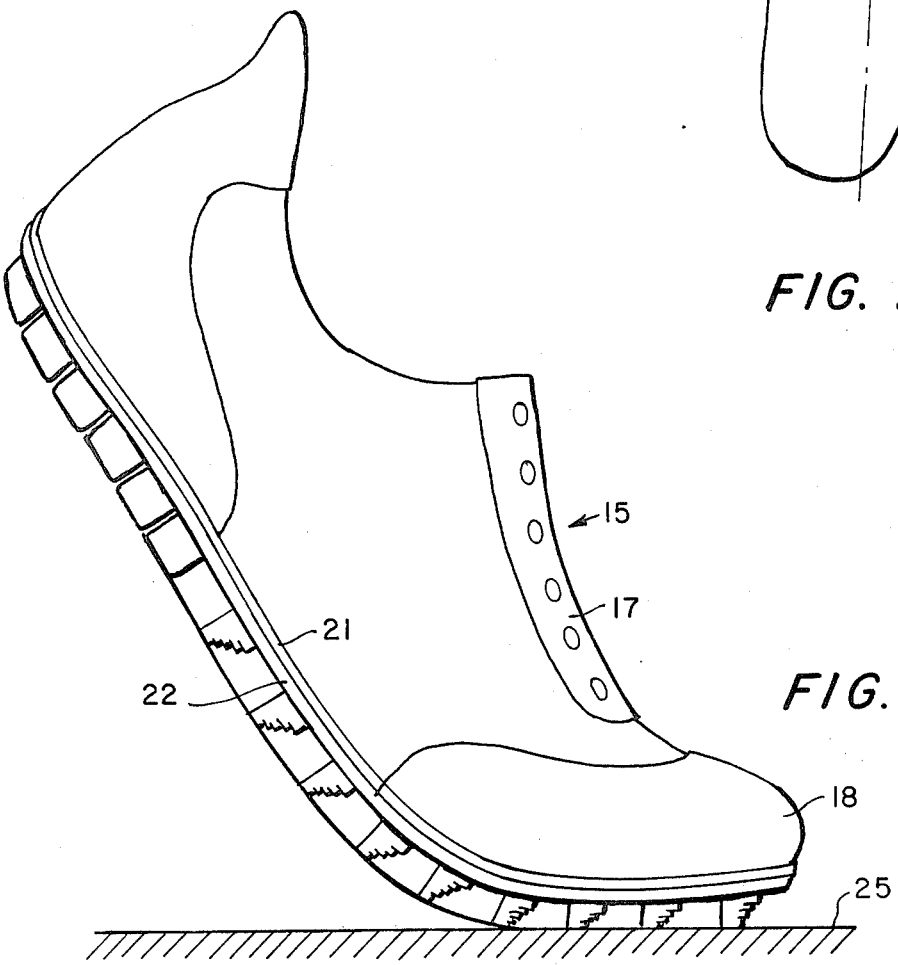
FIG. 5 shows the shoe bending in the manner necessary for running.

The shoe is shown in FIG. 5 during the pushoff stage of running with just the forward portion in contact with the ground or running surface 25. This stage of running requires the toe and forward portion of the foot to bend at an angle relative to the rest of the foot. In FIG. 2 is a top view of a foot comprising toes 26, heel 27 and a center portion 28. As can be seen by the dotted lines 29, 30 and 31, the forward portion of the foot generally bends along parallel joints which extend at an angle other than normal to a longitudinal axis 32 of the foot. The bending lines of the foot generally extend at an angle A of approximately 15° from a line 34 normal to the longitudinal axis of the foot. Thus the normal lines of bending of the foot extend generally 15° from perpendicular to the longitudinal axis of the foot.

Figure 3:
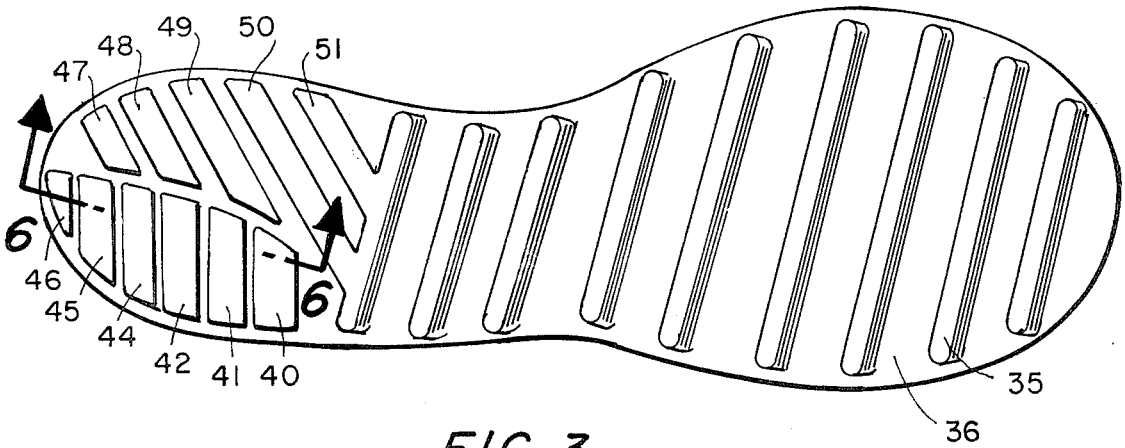
FIG. 3 is a bottom view of the shoe of FIG. 1.
Figure 6:
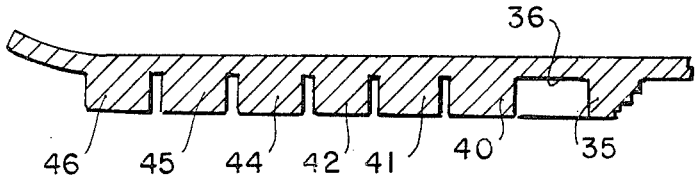
FIG. 6 is a cross-sectional view along the line 6—6 of FIG. 3.
Figure 4:
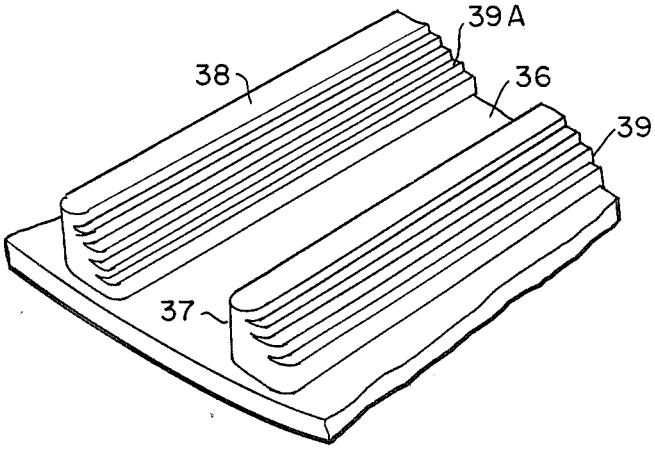
FIG. 4 is an enlarged perspective view of a section of the sole of FIG. 3.

It is the purpose of the present invention to provide a tread which not only will provide a greater wearing surface area in comparison to soles having cleats but will also provide improved traction and bending qualities to assist the runner. Accordingly as shown in FIGS. 1 and 3 the sole 22 is provided with a series of bar treads 35 separated by valley areas 36. The bar treads 35 and the valley areas 36 extend at an angle relative to the longitudinal axis of the foot roughly corresponding to the foot bending lines shown in FIG. 2. Preferably the bar treads have a rearward facing planar wall 37 and a downward facing planar wear surface 38 for contacting the running surface. The front wall 39 of the bar tread in the embodiment shown is of a stepped or serrated configuration formed of steps 39A extending from the valley area 36 between the bar treads.

In practice the rearward facing wall 37 of the bar treads provides gripping engagement with the running surface during running and acceleration. When the foot is set down on the running surface the sloping front surface 39 provides somewhat of a cushioning effect allowing the bar tread to roll rearward slightly for providing a resilient body to cushion the shock. As shown in FIG. 3, the bar treads extend along the sole below the toe and the mid-portions of the shoe. Under the heel there are located a series of pads 40, 41, 42, 44, 45 and 46 to provide a firm wear surface under the outer edge of the foot where most contact occurs as the heel is set down during running. These pads are of the same approximate thickness as the bar treads. Additional bar members 47, 48, 49, 50 and 51 are positioned on the bottom of the sole at the inner heel area. Less wearing takes place in this inner area therefore the pads are positioned further apart to lighten the weight of the shoe, yet provide sufficient cushioning and wearing surface. Pads are utilized under the heel to accommodate any slight bending of the heel portion of the shoe.

Thus it can be seen that the subject invention provides a shoe tread which has a greater wearing surface provided by the planar surfaces 38 than a cleated shoe, yet facilitates the bending of the shoe and foot. In addition improved traction is provided because of the increased area of the rearward facing walls 37 on the tread for gripping the running surface. The tread also is easier to keep clean than cleated shoes because foreign matter can be removed from the valley areas of the sole. Of course the tread members can be of various configurations and cross-sections so long as they are extended substantially along the bend lines of the foot.

The invention claimed is:

1. An athletic shoe for the foot wherein the foot has normal bend lines extending thereacross at an angle of approximately 15° to a line normal to the longitudinal axis of the foot, said shoe comprising, in combination:

a shoe upper portion having heel, shank and toe areas in that order for enclosing the wearer's foot;

a sole attached to said shoe upper portion for supporting the wearer's foot on a running surface, comprising:

a cushioning pad of pliable material and having upper and bottom surfaces with the upper surface fixed to the shoe upper portion and having a longitudinal axis and longitudinal edges extending along the length of the shoe upper portion; and a plurality of bar treads fixed to the bottom surface of the cushioning pad adjacent the toe and shank areas and positioned to extend substantially from one longitudinal edge thereof to the other and in a direction parallel to the normal bend lines of the foot.

2. An athletic shoe as defined in claim 1 wherein said bar treads are spaced apart to form valleys therebetween extending from one longitudinal edge of the cushioning pad to the other edge.

3. An athletic shoe as defined in claim 1 wherein said bar treads and valleys are positioned parallel to each other.

4. An athletic shoe as defined in claim 3 including raised pads of approximately the same thickness as the bar treads and fixed in spaced relationship to each other to the bottom surface of the cushioning pad adjacent the heel portion of the shoe.

5. An athletic shoe as defined in claim 4 wherein pads are positioned closer together adjacent one of the longitudinal edges of the cushioning pad than pads adjacent the other longitudinal edge.

* * * * *